US007458412B2

(12) United States Patent
Hirao

(10) Patent No.: US 7,458,412 B2
(45) Date of Patent: Dec. 2, 2008

(54) METHOD OF FORMING A HOUSING HAVING A THIN WALL AND THE HOUSING

(75) Inventor: Hiroaki Hirao, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/376,893

(22) Filed: Mar. 16, 2006

(65) Prior Publication Data

US 2006/0231230 A1 Oct. 19, 2006

(30) Foreign Application Priority Data

Apr. 15, 2005 (JP) ..... 2005-118640

(51) Int. Cl.
*B22D 29/00* (2006.01)
*B22D 17/22* (2006.01)

(52) U.S. Cl. ..... 164/131; 164/347

(58) Field of Classification Search ..... 164/347, 164/344, 342, 131
See application file for complete search history.

(56) References Cited

U.S. PATENT DOCUMENTS 2,304,899 A * 12/1942 Dupre ..... 164/347
5,566,743 A * 10/1996 Guergov ..... 164/457
5,915,453 A * 6/1999 Tremblay et al. ..... 164/347
6,206,682 B1 * 3/2001 Vovan ..... 425/556
2001/0001978 A1 * 5/2001 Hosoi et al. ..... 164/91

FOREIGN PATENT DOCUMENTS

| | | | |
|---|---|---|---|
| JP | 55-100865 | * | 8/1980 |
| JP | 55-100865 A | * | 8/1980 |
| JP | 355100865 | * | 8/1980 |
| JP | 357175068 | * | 10/1982 |
| JP | 2000-025062 | | 1/2000 |
| JP | 2002-166429 | | 6/2002 |
| JP | 2002-178338 | | 6/2002 |

OTHER PUBLICATIONS

"Manual of Founding Engineer", *document cited in office action within China counterpart application*, (Jan. 2003), 737-739.

* cited by examiner

*Primary Examiner*—Kevin P Kerns
(74) *Attorney, Agent, or Firm*—Blakely, Sokoloff, Taylor & Zafman LLP

(57) ABSTRACT

According to one embodiment, a housing is formed by using a pair of metal molds. The housing includes a first wall, second walls projecting from the first wall, and bosses projecting from the first wall. A molten material is filled into a molding space defined between the metal molds, and thereby a molded article having a shape corresponding to the housing is molded. The molded article has a plurality of first pin-receiving portions serving as the bosses, and a plurality of second pin-receiving portions projecting from the second walls. The first and the second pin-receiving portions are pushed by a plurality of ejector pins, and thereby the molded article is ejected from the metal molds.

14 Claims, 7 Drawing Sheets

METHOD OF FORMING A HOUSING HAVING A THIN WALL AND THE HOUSING

CROSS-REFERENCE TO RELATED APPLICATIONS

This application is based upon and claims the benefit of priority from Japanese Patent Application No. 2005-118640, filed Apr. 15, 2005, the entire contents of which are incorporated herein by reference.

BACKGROUND

1. Field

One embodiment of the invention relates to a method of forming a housing used for electronic apparatuses such as portable computers, in particular, a method of ejecting a molded article serving as a base of a housing from a metal mold by using a plurality of ejector pins. Further, the present invention relates to a housing that is molded by filling a molten material between a pair of metal molds.

2. Description of the Related Art

Recently, electronic apparatuses such as portable computers having a housing made of magnesium alloy are known. Housings made of magnesium alloy have advantages that reduction in weight and thickness can be more easily achieved while stiffness is secured than in housings made of synthetic resin or aluminum alloy.

Housings made of magnesium alloy are mass-produced by using molding devices. The molding device has a pair of metal molds which are detachably engaged. A molding space is formed between the metal molds. Molten magnesium alloy is filled into the molding space and hardened therein, and thereby a molded article having a shape corresponding to a housing is obtained. The molded article is ejected from the molds, and then subjected to chemical treatment, primer application, painting, and clear coating, etc.

When the molded article is ejected from the molds, a method of using a plurality of ejector pins is conventionally adopted. The ejector pins push up the molded article from one of the metal molds, and are vertically movably attached to one of the metal molds. The ejector pins are scattered to cover a wide range of the molded article such that they can push up the molded article without inclining the article.

On the other hand, a basic thickness of housings of magnesium alloy is empirically set to 0.8 mm or less. Therefore, the molded articles serving as a base of the housings are formed to have a very small thickness. Thus, if conventional ejector pins are adopted, the thin molded article may yield to a pushing force applied from the ejector pins when the molded article is ejected from the molds.

If the molded article is deformed, its surface serving as the exterior surface is warped. This warp causes diffusion of light after clear coating is applied to the molded article. Therefore, warp is particularly conspicuous in housings obtained by applying clear coating to molded articles. This causes deterioration in appearance of the housings.

BRIEF DESCRIPTION OF THE SEVERAL VIEWS OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, a method of forming a housing having a first wall, a plurality of second walls projecting from the first wall, and a plurality of bosses projecting from the first wall at positions different from positions of the second walls, the method comprises preparing a pair of metal molds, filling a molten material into a molding space defined between the metal molds, and thereby molding a molded article having a shape corresponding to the housing, the molded article having a plurality of first pin-receiving portions serving as the bosses and a plurality of second pin-receiving portions projecting from the second walls, and ejecting the molded article from the metal molds by pushing the first pin-receiving portions and the second pin-receiving portions of the molded article by a plurality of ejector pins.

Figure 1:
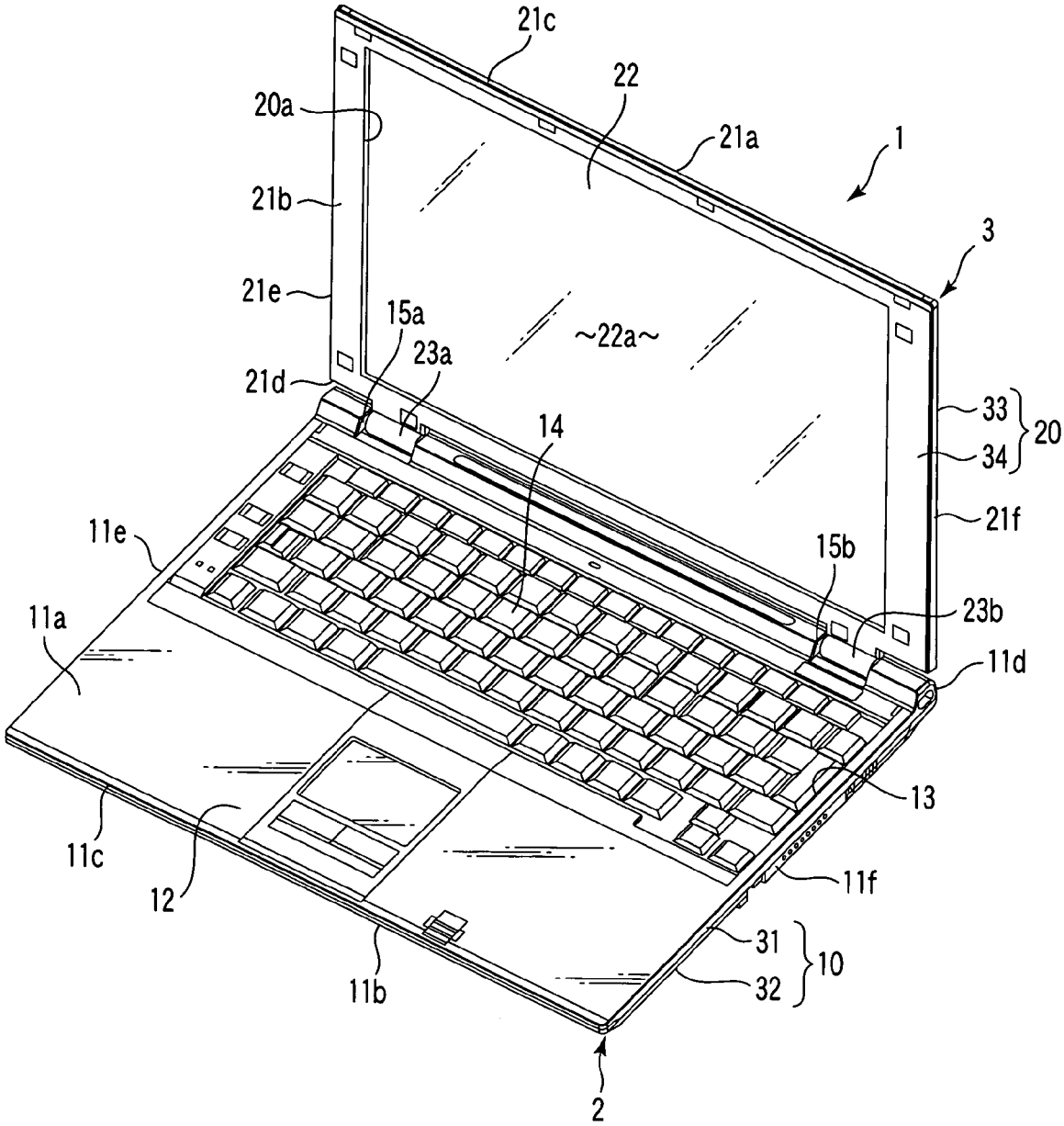
FIG. 1 is a perspective view of an exemplary portable computer according to an embodiment of the present invention.

FIG. 1 illustrates a portable computer 1 being an example of an electronic apparatus. The portable computer 1 comprises a main unit 2 and a display unit 3. The main unit 2 has a first housing 10. The first housing 10 contains main components, such as a hard disk drive and a printed circuit board. The first housing 10 has a flat box shape having a top wall 11*a*, a bottom wall 11*b*, a front wall 11*c*, a rear wall 11*d* and left and right side walls 11*e* and 11*f*. The top wall 11*a* is an example of a first wall. A front half of an external surface of the top wall 11*a* serves as a palm rest 12. The front wall 11*c*, the rear wall 11*d* and the side walls 11*e* and 11*f* are an example of a third wall, and projects downward from edges of the top wall 11*a*.

The top wall 11*a* of the first housing 10 has a keyboard attaching portion 13. The keyboard attaching portion 13 is positioned in the rear of the palm rest 12, and supports a keyboard 14.

The first housing 10 has a pair of display support portions 15*a* and 15*b* at a rear end portion of the top wall 11*a*. The display support portions 15*a* and 15*b* are depressions each opened in the frontward, upward and rearward directions, and they are provided apart from each other in the width direction of the first housing 10.

The display unit 3 has a second housing 20 and a liquid crystal display panel 22. The second housing 20 has a rear wall 21*a*, a front wall 21*b*, and first to fourth peripheral walls 21*c*, 21*d*, 21*e* and 21*f*. The rear wall 21*a* is an example of an end wall. The front wall 21*b* has an opening portion 20*a*. The first to fourth peripheral walls 21*c*, 21*d*, 21*e* and 21*f* stand on edges of the rear wall 21*a*.

The liquid crystal display panel 22 is contained in the second housing 20. The liquid crystal display panel 22 has a screen 22*a* that displays images. The screen 22*a* is exposed to the outside of the second housing 20 through the opening portion 20*a* of the front wall 21*b*.

The second housing 20 has a pair of leg portions 23*a* and 23*b* projecting from its bottom end. The leg portions 23*a* and 23*b* are apart from each other in the width direction of the second housing 20. The leg portions 23*a* and 23*b* are guided into the display support portions 15*a* and 15*b* of the first housing 10, respectively. Each of the leg portions 23*a* and 23*b* is supported by the first housing 10 with a hinge (not shown). Therefore, the display unit 3 is rotatable between a closed position and an open position. In the closed position, the display unit 3 is laid on the main unit 2 to cover the palm rest 12 and the keyboard 14 from above. In the open position, the display unit 3 stands on the rear end portion of the main unit 2 to expose the palm rest 12 and the keyboard 14.

The first housing 10 comprises a cover 31 and a case 32. The cover 31 and the case 32 are formed of, for example, magnesium alloy mainly consisting of magnesium. The cover 31 forms the top wall 11*a*, the front wall 11*c*, the rear wall 11*d* and the left and right side walls 11*e* and 11*f* of the first housing 10. The case 32 forms the bottom wall 11*b* of the first housing 10.

The cover 31 serves as a main part of the first housing 10. The cover 31 is exposed to the outside of the portable computer 1 when the display unit 3 is rotated to the open position, and very conspicuous in terms of the appearance. The cover 31 is set to have a thickness of 0.8 mm or less, preferably 0.6 mm or less.

The second housing 20 comprises a display cover 33 and a display mask 34. The display cover 33 and the display mask 34 are formed of, for example, magnesium alloy mainly consisting of magnesium. The display cover 33 forms the rear wall 21*a*, the first to fourth peripheral walls 21*c*, 21*d*, 21*e*, and 21*f* of the second housing 20. The display mask 34 forms the front wall 21*b* of the second housing 20.

The display cover 33 serves as a main part of the second housing 20. The display cover 33 is always exposed to the outside of the portable computer 1 regardless of the position of the display unit 3, and very conspicuous in terms of the appearance. At least a portion of the display cover 31 opposed to the liquid crystal display panel 22 is set to have a thickness of 0.8 mm or less, preferably 0.6 mm or less.

Figure 2:
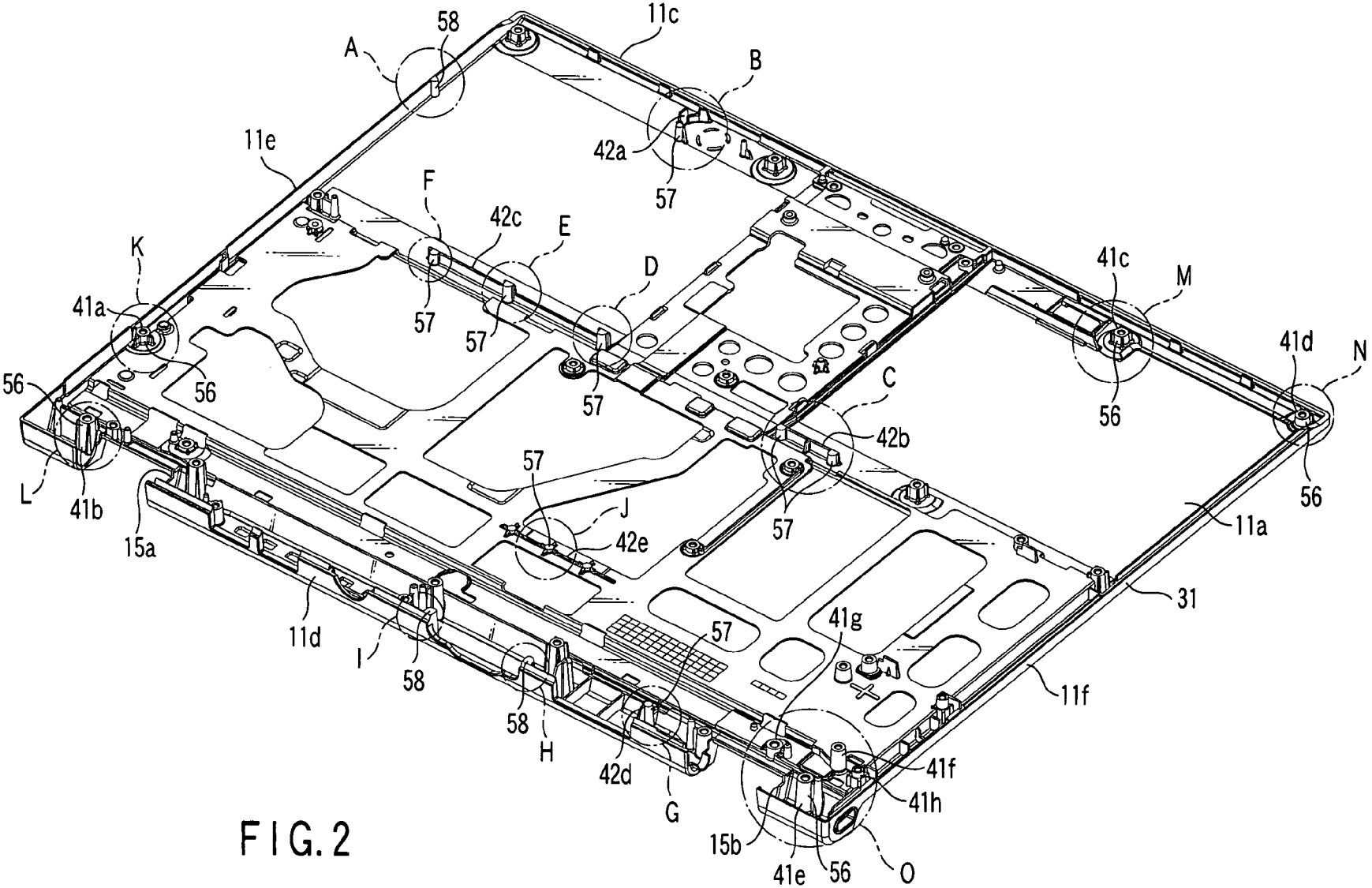
FIG. 2 is an exemplary perspective view of a cover of a first housing, in an inverted state, according to the embodiment of the present invention.
Figure 3:
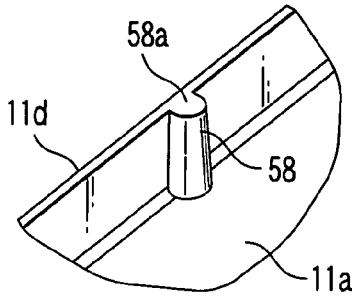
FIG. 3 is an exemplary enlarged perspective view of a circled area A in FIG. 2.
Figure 6:
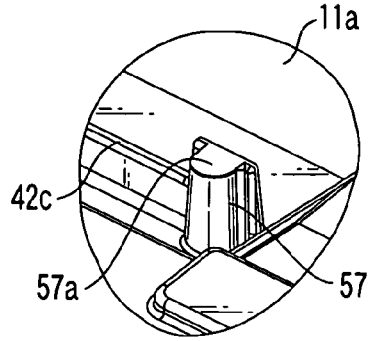
FIG. 6 is an exemplary enlarged perspective view of a circled area D in FIG. 2.
Figure 4:
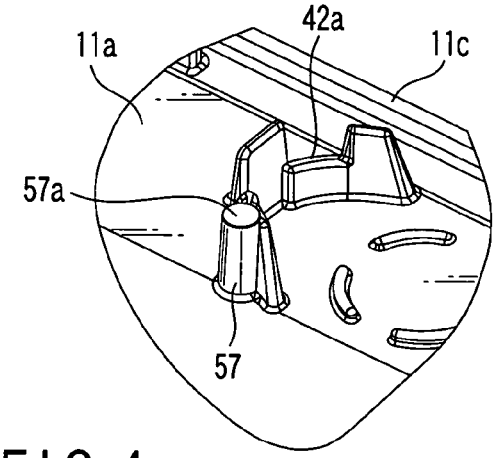
FIG. 4 is an exemplary enlarged perspective view of a circled area B in FIG. 2.
Figure 7:
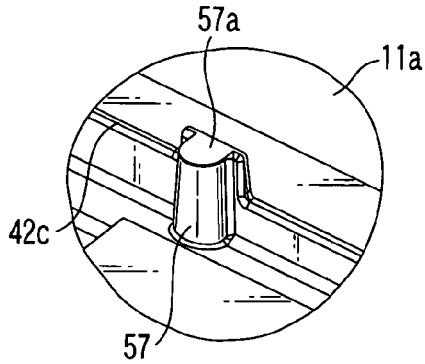
FIG. 7 is an exemplary enlarged perspective view of a circled area E in FIG. 2.
Figure 8:
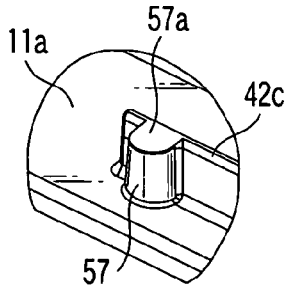
FIG. 8 is an exemplary enlarged perspective view of a circled area F in FIG. 2.
Figure 5:
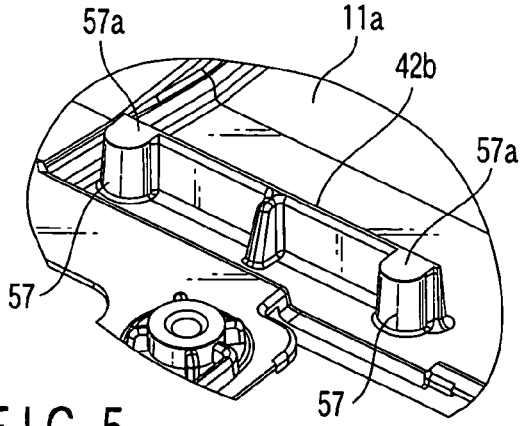
FIG. 5 is an exemplary enlarged perspective view of a circled area C in FIG. 2.
Figure 9:
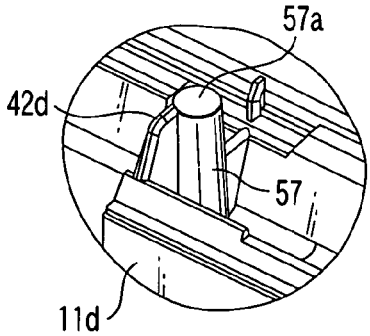
FIG. 9 is an exemplary enlarged perspective view of a circled area G in FIG. 2.
Figure 10:
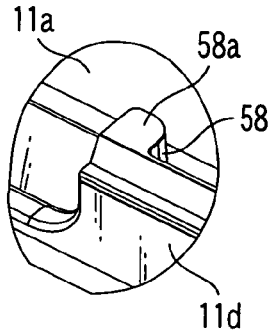
FIG. 10 is an exemplary enlarged perspective view of a circled area H in FIG. 2.
Figure 11:
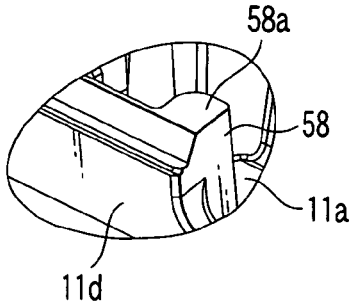
FIG. 11 is an exemplary enlarged perspective view of a circled area I in FIG. 2.
Figure 12:
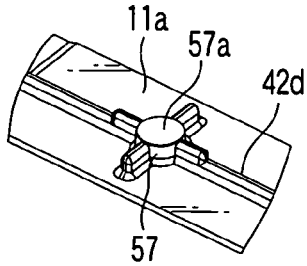
FIG. 12 is an exemplary enlarged perspective view of a circled area J in FIG. 2.
Figure 13:
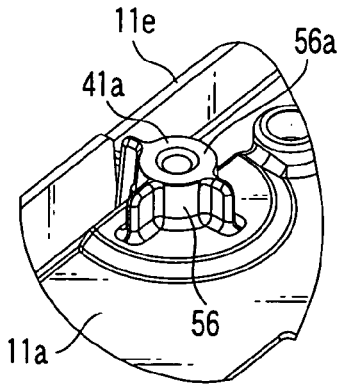
FIG. 13 is an exemplary enlarged perspective view of a circled area K in FIG. 2.
Figure 14:
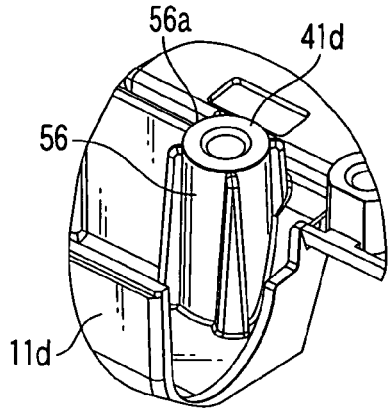
FIG. 14 is an exemplary enlarged perspective view of a circled area L in FIG. 2.
Figure 15:
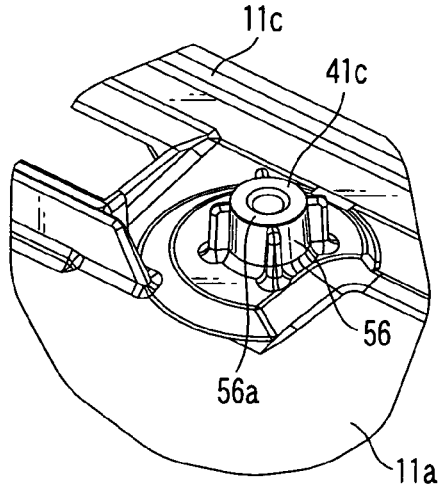
FIG. 15 is an exemplary enlarged perspective view of a circled area M in FIG. 2.
Figure 16:
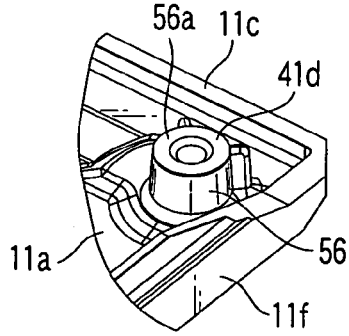
FIG. 16 is an exemplary enlarged perspective view of a circled area N in FIG. 2.
Figure 17:
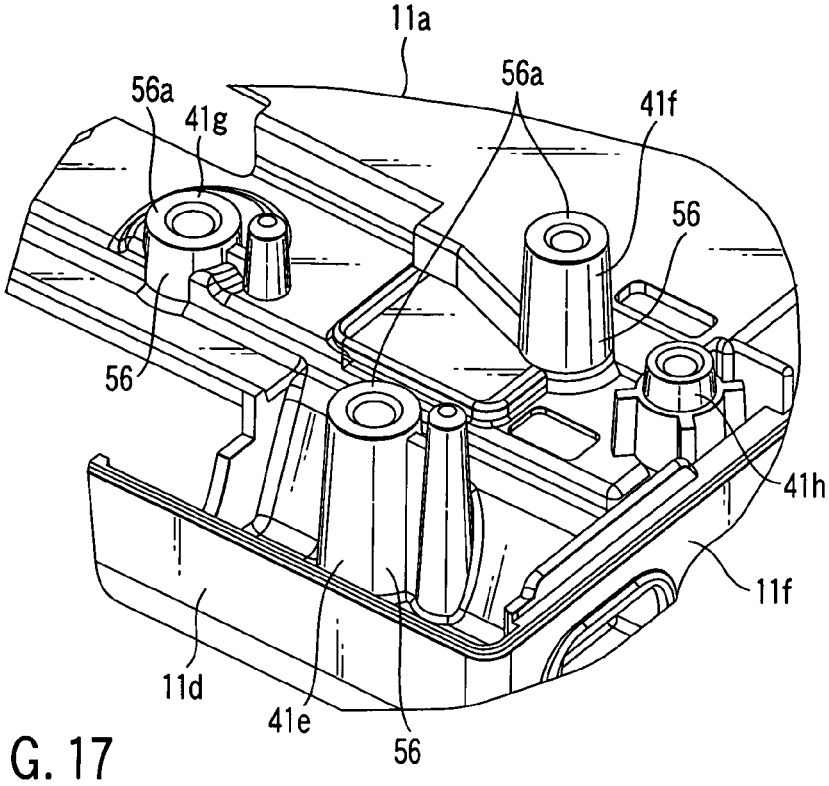
FIG. 17 is an exemplary enlarged perspective view of a circled area 0 in FIG. 2.

FIG. 2 illustrates the cover 31 in an inverted state. As shown in FIGS. 2 to 17, a plurality of bosses 41*a* to 41*h* and a plurality of rib-shaped partition walls 42*a* to 42*e* are formed as unitary piece with the cover 31, on an internal surface of a portion of the cover 31 forming the top wall 11*a* of the first housing 10. The bosses 41*a* to 41*h* project from the internal surface of the top wall 11*a* in the thickness direction of the top wall 11*a*. The partition walls 42*a* to 42*e* are an example of a second wall, and project from the internal surface of the top wall 11*a* in the thickness direction of the top wall 11*a*. The bosses 41*a* to 41*h* are provided in positions different from those of the partition walls 42*a* to 42*e*.

Figure 20:
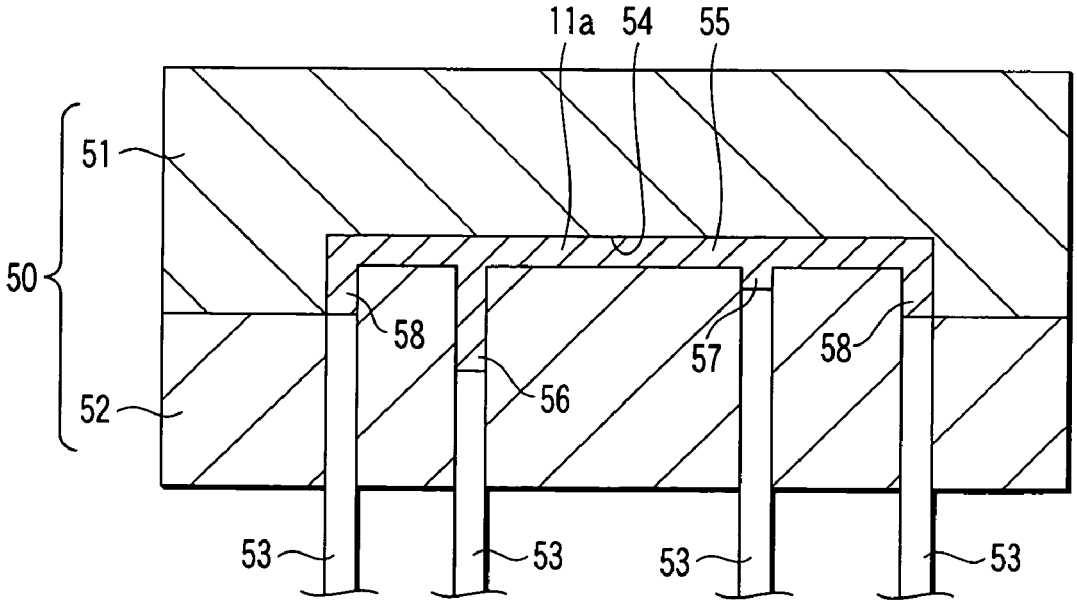
FIG. 20 is an exemplary cross-sectional view illustrating a state where magnesium alloy is filled into a molding space between a pair of metal molds according to the embodiment of the present invention.
Figure 21:
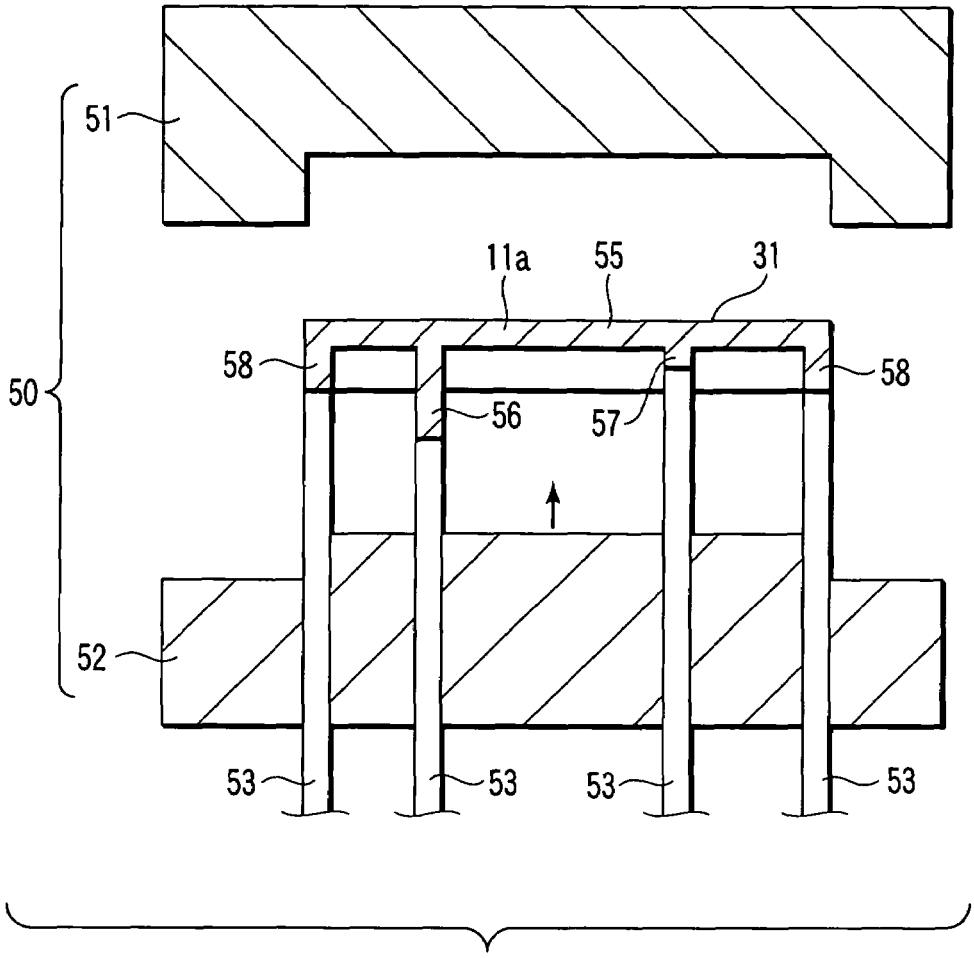
FIG. 21 is an exemplary cross-sectional view illustrating a state where the molded article is ejected from the metal molds by using ejector pins, according to the embodiment of the present invention.

Each of the first housing 10 and the second housing 20 is molded by using a molding device. FIGS. 20 and 21 illustrate a molding device 50 for molding the cover 31 of the first housing 10. The molding device 50 comprises a first metal mold 51 having a cavity, a second metal mold 52, and a plurality of ejector pins 53.

The first metal mold 51 and the second metal mold 52 are engaged in a vertically separatable manner. The first metal mold 51 and the second metal mold 52 forms a molding space 54 when they are engaged.

Figure 19:
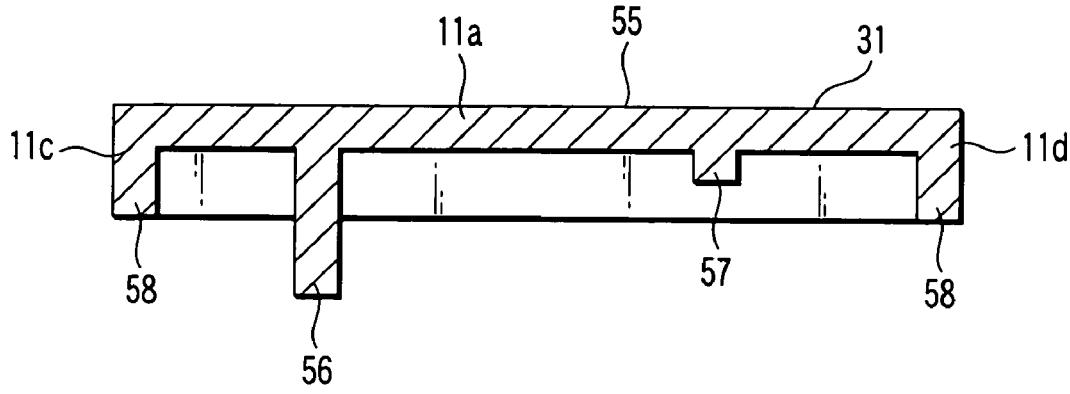
FIG. 19 is an exemplary schematic cross-sectional view of a molded article forming the cover according to the embodiment of the present invention.

The molding space 54 is used for obtaining a molded article 55 having a shape corresponding to the cover 31. As schematically shown in FIGS. 19 and 20, the molded article 55 has a plurality of first pin-receiving portions 56 serving as the boss portions 41*a* to 41*h*, a plurality of second pin-receiving portions 57 projecting from portions serving as the partition walls 42*a* to 42*e*, and a plurality of third pin-receiving portions 58 projecting from portions serving as the front wall 11*c*, the side wall 11*e* and the rear wall 11*d*. In other words, the first and the second metal molds 51 and 52 are designed such that the first to third pin-receiving portions 56 to 58 are formed together with the molded article 55.

As shown in FIGS. 2 to 17, the first to third pin-receiving portions 56 to 58 are an example of projections, and each pin-receiving portion has a generally columnar shape. The first to third pin-receiving portions 56 to 58 project from an internal surface of a portion, which serves as the top wall 11*a*, in the molded article 55. The first to third pin-receiving portions 56 to 58 have respective tip end surfaces 56*a* to 58*a*. The tip end surface 57*a* of each second pin-receiving portion 57 preferably has a thickness greater than the thickness of portions of the molded article 55 serving as the partition walls 42*a* to 42*e*, and is smaller than the tip end surface 56*a* of each first pin-receiving portion 56. Further, the first to third pin-receiving portions 56 to 58 are provided to scatter over a wide range of the portion, which serves as the top wall 11*a*, in the molded article 55.

The ejector pins 53 push up and eject the molded article 55 from the second metal mold 52, and are vertically movably supported by the second metal mold 52. The ejector pins 53 are provided in positions corresponding to the first to third pin-receiving portions 56 to 58 of the molded article 55, such that they can push up the molded article 55 without inclining it.

Next, explained is a procedure of molding the cover 31 of the first housing 10 using the molding device 50.

First, the first metal mold 51 and the second metal mold 52 are engaged with each other, and thereby the molding space 54 is formed between the first and second metal molds 51 and 52. Next, molten magnesium alloy is injected into the molding space 54. When the molding space 54 has been filled with the magnesium alloy, after a cooling period of several seconds, the first metal mold 51 and the second metal mold 52 are moved in directions of going away from each other. This step exposes a molded article 55 having a shape corresponding to the cover 31 to the outside of the molding device 50, and thus the molded article 55 is ejected from the molding device 50.

As shown in FIG. 21, when the molded article 55 is ejected from the molding device 50, the ejector pins 53 are ascended. The ejector pins 53 meet the tip end surfaces 56*a* to 58*a* of the first to third pin-receiving portions 56 to 58 of the molded article 55, and push up the molded article 55 from the second metal mold 52. As a result, the molded article 55 is separated from the second metal mold 52, and thereby the molded article 55 is ejected from the molding device 50.

Figure 22:
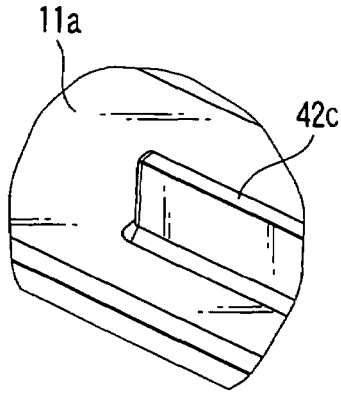
FIG. 22 is an exemplary perspective view of the molded article in a state where a second pin-receiving portion shown in FIG. 8 is ejected therefrom, according to the embodiment of the present invention.

After the molded article 55 is ejected from the molding device 50, the bosses 41*a* to 41*h* are formed by processing the first pin-receiving portions 56. Among the second pin-receiving portions 57, those which do not obstruct accommodation of main components in the first housing 10 may be maintained in the molded article 55. Some of the second pin-receiving portions 57 which interfere with the main components are cut away from the molded article 55. Thereby, as is clear from comparison between FIG. 8 and FIG. 22, some of the second pin-receiving portions 57 are removed from the partition wall 42*c*. Some of the third pin-receiving portions 58 are removed from the molded article 55, if necessary.

After completion of processing of the molded article 55, the molded article 55 is subjected to chemical treatment for rust proofing. Then, the molded article 55 is subjected to primer application, painting, and clear coating being an example of high-gloss coating. The gloss-coating is applied to enhance abrasion resistance and appearance quality of the molded article 55, and is not limited to coating using transparent paint.

Through the above steps, the cover 31 being part of the first housing 10 is finished.

According to the above method of forming the cover 31, when the molded article 55 serving as a base of the cover 31 is ejected from the molding device 50, the ejector pins 53 pushes upward the first to third pin-receiving portions 56 to 58 of the molded article 55. Each of the first to third pin-receiving portions 56 to 58 has a thickness larger than that of portions of the molded article 55 serving as the thin top wall 11*a*, and has high stiffness. This means that the ejector pins 53 push up the portions having high stiffness in the molded article 55.

In other words, the ejector pins 53 do not push up the portions of the molded article 55, which are thin and easily deformed, and the molded article 55 does not yield to the pushing force applied from the ejector pins 53. Therefore, the molded article 55 is finished as cover 31 having little warp or deformation, and it is possible to obtain a cover 31 having good appearance and not causing light diffusion.

The case 32 of the first housing 10 can be formed by using a molding device similar to that of the cover 31. Therefore, explanation of the method of forming the case 32 is omitted.

Next, explained is a method of forming the display cover 33 of the second housing 20. A portion of the display cover 33, serving as the rear wall 21*a*, has a size to cover the liquid crystal display panel 22, and a very small thickness of 0.6 mm.

Figure 18:
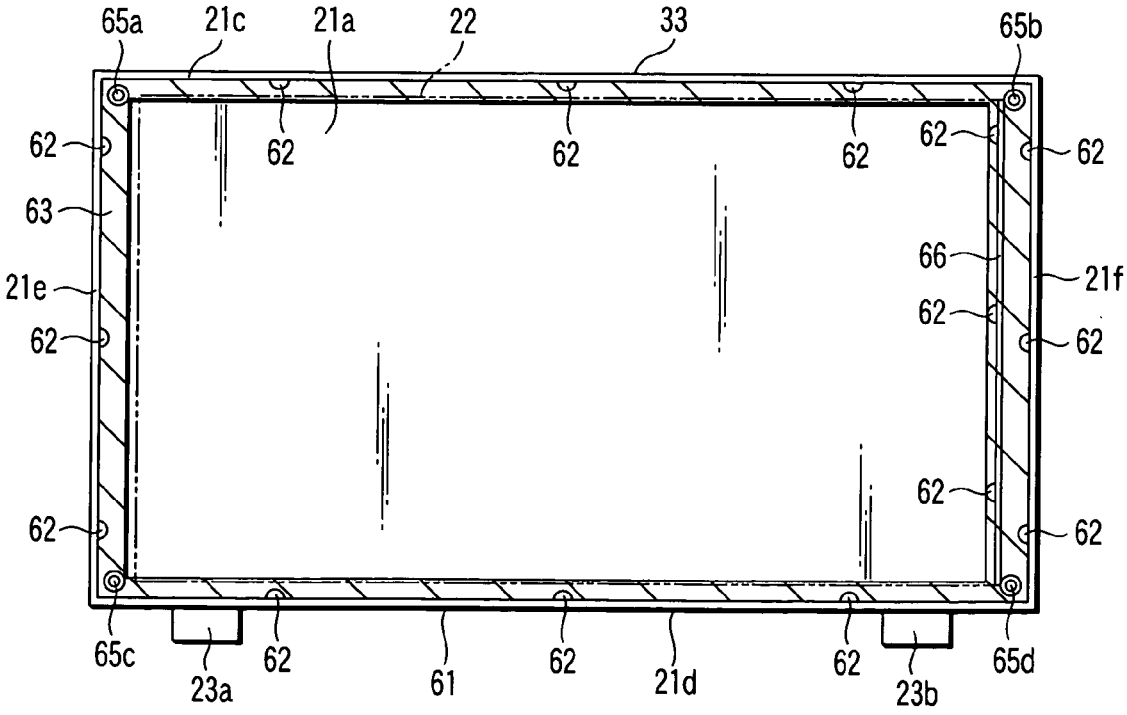
FIG. 18 is an exemplary plan view of a display cover being a part of a display unit according to the embodiment of the present invention.

A molding device for molding the display cover 33 comprises a first metal mold 51, a second metal mold 52 and a plurality of ejector pins 53, in the same manner as the molding device 50 for forming the cover 31. A molding space 54 defined between the first metal mold 51 and the second metal mold 52 is used for obtaining a molded article 61 having a shape corresponding to the display cover 33 as shown in FIG. 18.

The molded article 61 has a plurality of pin-receiving portions 62 projecting from portions serving as the first to fourth peripheral walls 21*c* to 21*f*. Each of the pin-receiving portions 62 has a generally columnar shape, and is provided on a peripheral area 63 in the portion of the molded article 61 serving as the rear wall 21*a*. As shown in FIG. 18 with hatching, the peripheral area 63 extends along the first to fourth peripheral walls 21*c* to 21*f* of the molded article 61, and surrounds the liquid crystal display panel 22.

Further, if the molded article 61 also has a plurality of bosses 65*a* to 65*d* projecting from the portion serving as the rear wall 21*a* and a standing wall 66 projecting from the portion serving as the rear wall 21*a*, the bosses 65*a* to 65*d* and the standing wall 66 are provided in the peripheral area 63. The standing wall 66 supports the liquid crystal display panel 22, and has some of the pin-receiving portions 62. Therefore, the first and second metal molds 51 and 52 are designed such that the pin-receiving portions 62, the bosses 65*a* to 65*d* and the standing wall 66 are formed together with the molded article 61.

The ejector pins 53 push up and eject the molded article 61 from the second metal mold 52, and are vertically movably supported by the second metal mold 52. The ejector pins 53 are provided in positions corresponding to the pin-receiving portions 62 and the boss portions 65*a* to 65*d* of the molded article 61, such that they can push up the molded article 61 without inclining it.

To form the display cover 33, first, molten magnesium alloy is injected into the molding space 54 of the molding device 50. Then, after a cooling period of several seconds, the first metal mold 51 and the second metal mold 52 are moved in directions of going away from each other, and thereafter the molded article 61 is ejected therefrom.

When the molded article 61 is ejected from the molding device 50, the ejector pins 53 are ascended. The ejector pins 53 meet the pin-receiving portions 62 and the bosses 65*a* to 65*d* of the molded article 61, and push up the molded article 61 from the second metal mold 52. As a result, the molded article 61 is separated from the second metal mold 52, and thereby the molded article 61 is ejected from the molding device 50.

After the molded article 55 is ejected from the molding device 50, the bosses 65*a* to 65*d* are processed and, if necessary, some of the second pin-receiving portions 62 are cut away from the molded article 61, in the same manner as in the cover 31. Then, the molded article 61 is subjected to chemical treatment for rust proofing, primer application, painting, and gloss coating. Through the above steps, the display cover 33 being part of the second housing 20 is finished.

According to the above method of forming the display cover 33, when the molded article 61 serving as a base of the display cover 33 is ejected from the molding device 50, the ejector pins 53 pushes upward the pin-receiving portions 62 and the bosses 65*a* to 65*d* of the molded article 61. Therefore, the ejector pins 53 do not push up a thin portion of the molded article 61, which corresponds to the rear wall 21*a*, and the molded article 61 does not yield to the pushing force applied from the ejector pins 53. Therefore, the molded article 61 is finished as display cover 33 having little warp or deformation and having high quality.

Therefore, it is possible to obtain a display cover 33 having good appearance even if the molded article 61 is subjected to gloss coating.

The display mask 34 of the second housing 20 is formed by using a molding device similar to that for the display cover 33. Therefore, explanation of a method of forming the display mask 34 is omitted.

The present invention is not limited to a housing for portable computers and a method of forming thereof. For example, the present invention can be carried out as a housing for electronic apparatuses other than portable computers or other apparatuses.

While certain embodiments of the inventions have been described, these embodiments have been presented by way of example only, and are not intended to limit the scope of the inventions. Indeed, the novel methods described herein may be embodied in a variety of other forms; furthermore, various omissions, substitutions and changes in the form of the methods described herein may be made without departing from the spirit of the inventions. The accompanying claims and their equivalents are intended to cover such forms or modifications as would fall within the scope and spirit of the inventions.

What is claimed is:

1. A method of forming a housing having a plurality of peripheral walls attached to a top wall that is positioned under components contained within the housing, the method comprising:

preparing a pair of metal molds;

filling a molten material into a molding space defined between the metal molds, and thereby molding a molded article having a shape corresponding to the housing, the molded article having a plurality of pin-receiving portions formed in a planar orientation and as part of a partition wall that is different than any of the plurality of peripheral walls, the partition wall being formed as an unitary piece of the housing and projecting upwardly from an internal surface of the top wall; and ejecting the molded article from the metal molds by pushing the pin-receiving portions of the molded article by a first plurality of ejector pins.

2. A method according to claim 1, wherein when the partition wall borders a first component of the components to separate the first component from a second component of the components.

3. A method according to claim 2, wherein the partition wall is configured to secure the first component within the housing.

4. A method according to claim 2, wherein the partition wall is configured to be oriented lengthwise and in parallel with at least one of the plurality of peripheral walls.

5. A method according to claim 1, wherein the ejecting of the molded article further comprises pushing a plurality of bosses of the molded article by a second plurality of ejector pins, the plurality of bosses being formed in positions adjacent to and in contact with the plurality of peripheral walls.

6. A method according to claim 1, wherein the ejecting of the molded article further comprises pushing a second plurality of pin-receiving portions of the molded article by a second plurality of ejector pins, the second plurality of pin-receiving portions being formed as part of a first peripheral wall of the plurality of peripheral walls and projecting outwardly thereby increasing a width of the first peripheral wall.

7. A method of forming a housing including an end wall and a plurality of peripheral walls extending from the end wall and surrounding a component, the method comprising:

filling a molten material into a molding space defined between a plurality of metal molds to create a molded article having a shape corresponding to the housing, the molded article including a first plurality of pin-receiving portions formed in a planar orientation part of a partition wall that is surrounded by the plurality of peripheral walls, the partition wall being formed as an unitary piece of the housing and projecting upwardly from an internal surface of the end wall; and ejecting the molded article from the metal molds by pushing the first plurality of pin-receiving portions of the molded article by a plurality of ejector pins.

8. The method according to claim 7, wherein the ejecting of the molded article further comprises pushing a second plurality of pin-receiving portions of the molded article by a second plurality of ejector pins, the second plurality of pin-receiving portions being formed as part of a first peripheral wall of the plurality of peripheral walls and projecting laterally thereby increasing a width of the first peripheral wall.

9. A method according to claim 8, wherein the ejecting of the molded article further comprises pushing a third plurality of pin-receiving portions of the molded article operating as bosses, the third plurality of pin-receiving portions being formed in positions adjacent to the plurality of peripheral walls.

10. A method according to claim 7, wherein the partition wall borders the component to physically separate the component from another component situated in the housing.

11. A method according to claim 7, wherein the partition wall is configured to be oriented in parallel with at least one of the plurality of peripheral walls.

12. A method of forming a housing including a top wall and a plurality of peripheral walls extending from the top wall, the method comprising:

filling a molten material into a molding space defined between a plurality of metal molds to create a molded article having a shape corresponding to the housing, the molded article including at least one pin-receiving portion formed as part of a partition wall surrounded by the plurality of peripheral walls, the partition wall being formed as an unitary piece of the housing and projecting upwardly from an internal surface of the top wall; and ejecting the molded article from the metal molds by pushing the at least one pin-receiving portions of the molded article by corresponding ejector pins.

13. A method according to claim 12, wherein the molded article further comprises a plurality of pin-receiving portions being formed as part of a first peripheral wall of the plurality of peripheral walls and projecting laterally thereby increasing a width of the first peripheral wall at the pin-receiving portions.

14. A method according to claim 13, wherein the ejecting of the molded article from the metal molds further comprises pushing the plurality of pin-receiving portions of the molded article by a plurality of ejector pins.

* * * * *